United States Patent [19]

Wildhaber

[11] 4,028,019

[45] June 7, 1977

[54] POSITIVE-DISPLACEMENT UNIT WITH COAXIAL ROTORS

[76] Inventor: Ernest Wildhaber, 124 Summit Drive, Rochester, N.Y. 14620

[22] Filed: Feb. 4, 1976

[21] Appl. No.: 655,161

Related U.S. Application Data

[63] Continuation-in-part of Ser. No. 551,102, Feb. 20, 1975, Pat. No. 4,003,681.

[52] U.S. Cl. ..... 418/36; 74/393

[51] Int. Cl.[2] ..... F01C 1/00; F16H 35/02

[58] Field of Search ..... 418/36; 123/8, 47; 74/393, 437

[56] References Cited

UNITED STATES PATENTS

| | | | |
|---|---|---|---|
| 1,298,838 | 4/1919 | Weed | 123/8.47 |
| 2,108,385 | 2/1938 | Murakami | 418/36 |
| 3,585,874 | 6/1971 | Ingham | 74/393 |
| 3,769,946 | 11/1973 | Scherrer | 418/36 |

FOREIGN PATENTS OR APPLICATIONS

| | | | |
|---|---|---|---|
| 557,751 | 5/1923 | France | 418/36 |
| 684,714 | 3/1930 | France | 418/36 |
| 669,498 | 12/1938 | Germany | 418/36 |

*Primary Examiner*—John J. Vrablik

[57] ABSTRACT

Two coaxial rotors are connected with a counter-shaft through two pairs of varying-motion gears of opposite phase. They are designed to provide perfect mass-balance. Each gear rigid with a rotor contains two diametricaly opposite maximum radii, and perpendicular thereto two minimum radii. Its pitch lines that roll on the mate without slippage reach further out from the pitch circle of an imaginary uniform-motion gear of a pair having the same axes and tooth ratio than they recede inwardly of said circle; and they are more curved at the maximum radii than an ellipse of the same maximum and minimum radii. These features secure perfect mass balance.

Here now the gear teeth are uniformly spaced along the pitch lines and have a constant inclination thereto.

The invention also provides a simplified procedure for mass production, that contains fewer steps and thereby provides higher accuracy than hitherto possible with gear teeth uniformly spaced along pitch lines of varying radii.

5 Claims, 20 Drawing Figures

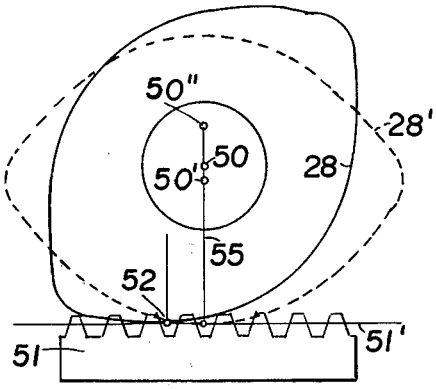
FIG. 9
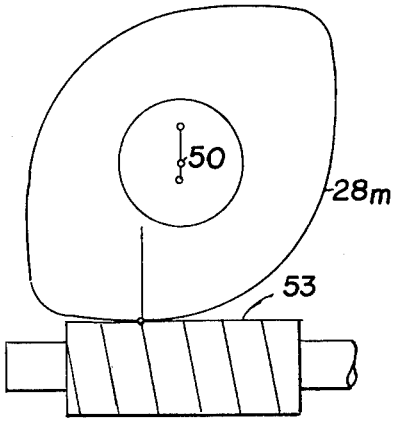
FIG. 10
FIG. 11
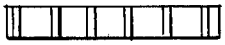
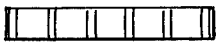
FIG. 16
FIG. 12
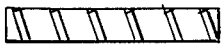
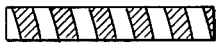
FIG. 17
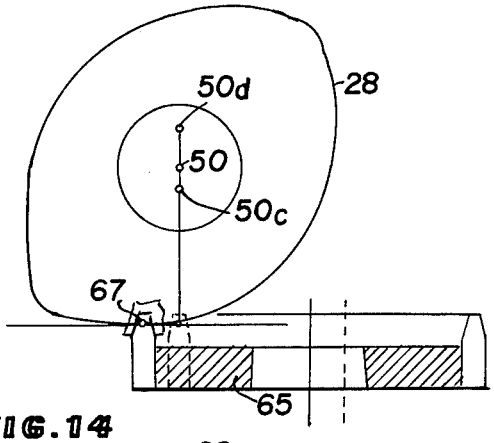
FIG. 14
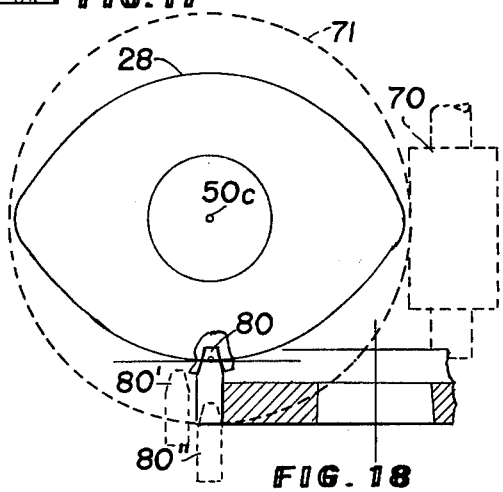
FIG. 18
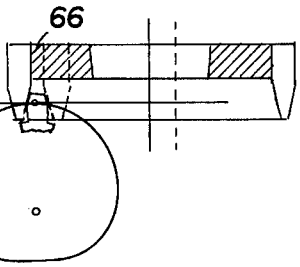
FIG. 15
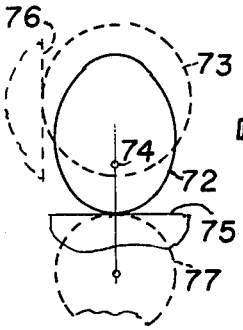
FIG. 19
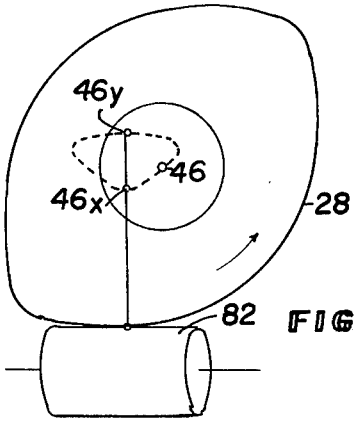
FIG. 20

POSITIVE-DISPLACEMENT UNIT WITH COAXIAL ROTORS

This is a continuation-in-part of my prior application of the same title, filed Feb. 20, 1975, Ser. No. 551,102 now U.S. Pat. No. 4,003,681.

The invention applies to compressors, pumps, engines and generally to positive-displacement units. It contains two coaxial rotors. A counter-shaft extends preferably parallel to the axis of the rotors. It is connected with the rotors through two pairs of varying-motion gears of opposite phase. These gear pairs providing full mass-balance, and their simplified production in quantity, are the chief novel features of the invention.

The invention will be described in connection with the accompanying drawings, in which FIG. 1 is a section laid through the rotor axis and the axis of the offset counter-shaft of an engine constructed according to the present invention. Its varying-motion gear pairs 27/28 and 27'/28' have each a tooth ratio of 1:2.

FIG. 9 is a diagram describing the production of a gear secured to a rotor with a reciprocatory rack-shaped tool.

FIG. 10 is a corresponding diagram showing a threaded worm in engagement with a master gear coaxial with the workpiece of FIG. 9.

FIGS. 11 and 12 are fragmentary views of rack-shaped tools for cutting straight and inclined teeth respectively, corresponding to FIG. 9.

FIGS. 9 to 13 also illustrate the need for a relative depthwise feed motion towards and away from the axis of the workpiece.

FIGS. 14 to 20 show the use of rotary tools, also using master gears except for the embodiment of FIGS. 18 and 19.

FIG. 14 diagrammatically describes the cutting of a rotor gear with a cutter of facemill-type. It operates in one tooth space at a time.

FIG. 15 is a corresponding view showing the cutting of a pinion to mate with the gear shown in FIG. 14.

FIG. 16 is a fragmentary view of a rack such as may be successively represented by the face mill shown in FIG. 14. It shows teeth of zero mean inclination to the direction of the gear axis.

FIG. 17 is a fragmentary sectional view of a similar rack with teeth inclined to the direction of the gear axis.

FIG. 18 is a diagram explaining a gear production without resorting to a master gear.

FIG. 19 is a diagram showing a way to attain feeds in two directions at right angles to each other, each feed being individually controlled.

FIG. 20 is a diagram referring to hobbing a gear of a varying-motion pair.

Figure 2:
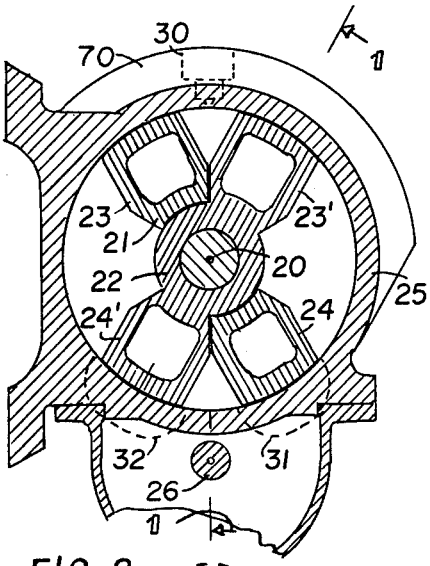
FIG. 2 is a cross-section taken along lines 2—2 of FIG. 1, looking along said axes.
Figure 1:
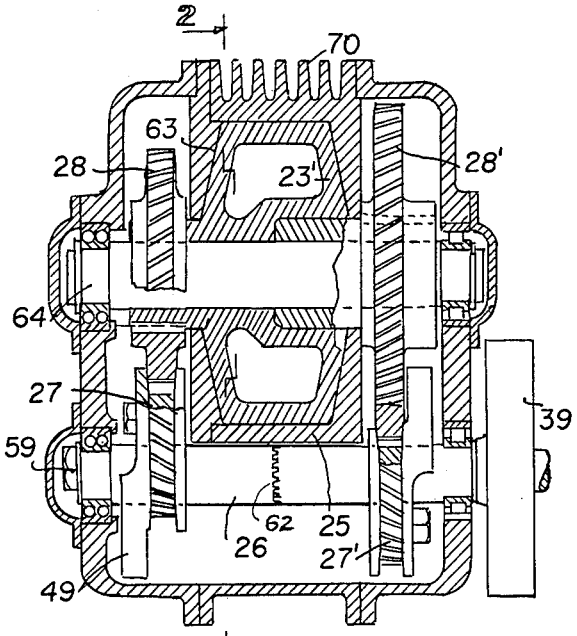
Figure 3:
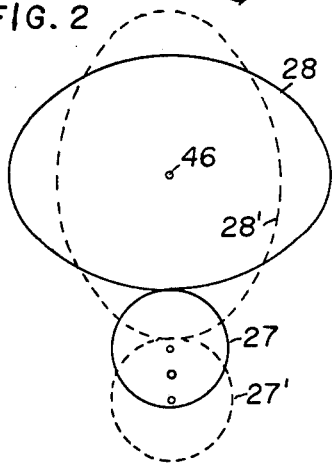
FIG. 3 is a diagram corresponding to FIG. 2 showing the approximate pitch lines of the two varying-motion gear pairs that connect the counter-shaft with the two rotors.
Figure 4:
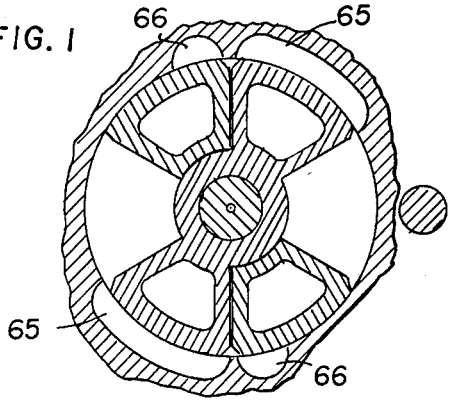
FIG. 4 is a fragmentary cross-section generally similar to FIG. 2 of a unit embodied as a compressor for air or gases.
Figure 6:
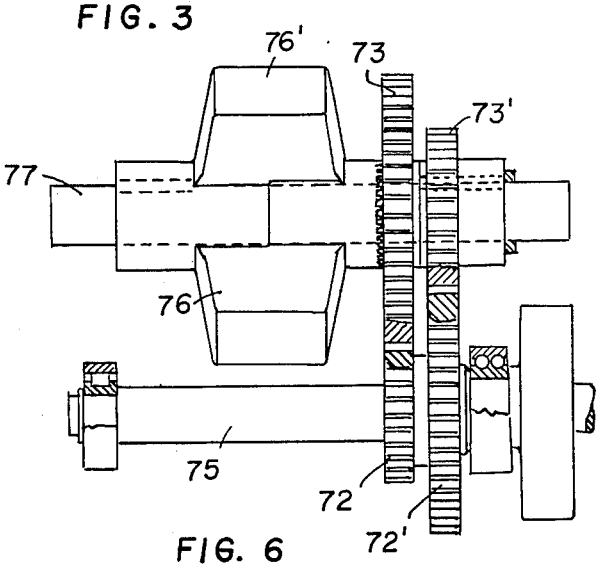
FIG. 6 is a section laid through the rotor axis and the axis of the offset counter-shaft of an engine, wherein the two gears of each pair of varying-motion gears have equal numbers of teeth.
Figure 5:
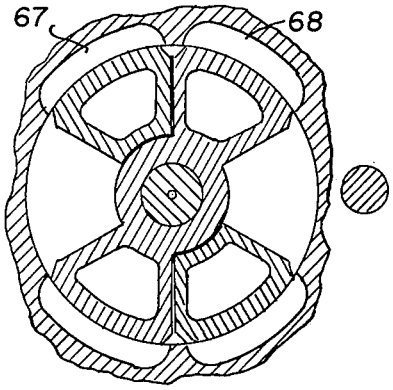
FIG. 5 is a similar cross-section of a pump for liquids, taken at right angles to the axes of the rotors and of the counter-shaft.

In FIGS. 1 to 3 numeral 20 denotes the common axis of the rotors 21, 22. The rotors contain each a pair of arms or blades 23, 24 and 23', 24', that project outwardly from axis 20 inside of a housing 25 with cylindrical inside surface. The two rotors are geared to an offset shaft or counter-shaft 26 by two pairs 27, 28 and 27',28' of varying-motion gears of opposite phase, so that the spaces between said arms periodically change the volume included between them and the housing. In this embodiment the gears 27, 27' on the offset shaft contain half the numbers of teeth on the gears, 28, 28'. Ignition 30 is at the shown top, adjacent the minimum space between the arms shown at 23, 23'.

After half a turn of the offset shaft 26, the arms 23, 23' will be in the positions of the arms 23',24, where they include a maximum space between each other. Expansion is completed. Exhaust starts through channel 31 and continues as the arms come together again. It ends when the arms are in positions 24, 24' after a further half-turn of the offset shaft. Intake starts through channel 32. It is completed when the arms have reached positions 24',23. Then compression starts. It ends in the arm position 23, 23'. Ignition occurs just before this position. And a new cycle starts after two full turns of the offset shaft 26.

Known sealing elements are preferably used at the rotor arms, but are not shown at the small scale used.

Perfect mass-balance is attained by keeping the angular acceleration of one rotor equal to the angular deceleration of the other rotor at all times.

According to the invention the varying-ratio gears are made to enforce a relationship, whereby on uniform rotation of the offset counter-shaft each rotor has a uniform rotation plus a harmonic motion added to it. When $\theta$ denotes the turning angle of the offset shaft, the turning angle $\theta'$ of a rotor may be described by $$\theta' = \tfrac{1}{2}\,\theta + c \sin \theta$$

for tooth ratios of 1:2; and the angular velocity by $$d\theta'/d\theta = \tfrac{1}{2} + c \cos \theta$$

Similarly, when the two gears of a pair have equal tooth numbers, and an overall tooth ratio of 1:1, the turning angle $\theta'$ of a rotor can be expressed in terms of the turning angle $\theta$ of the offset shaft by $$\theta' = \theta + c \sin 2\theta \text{ ; and}$$

$$d\theta'/d\theta = 1 + 2c \cos 2\theta$$

It will be shown now that the two gears even of a pair with equal tooth numbers have to differ from each other for full mass-balance. The gear motion is generally described by pitch lines or pitch curves that roll on each other without slippage and are rigid respectively with the two gears of a pair.

Figure 8:
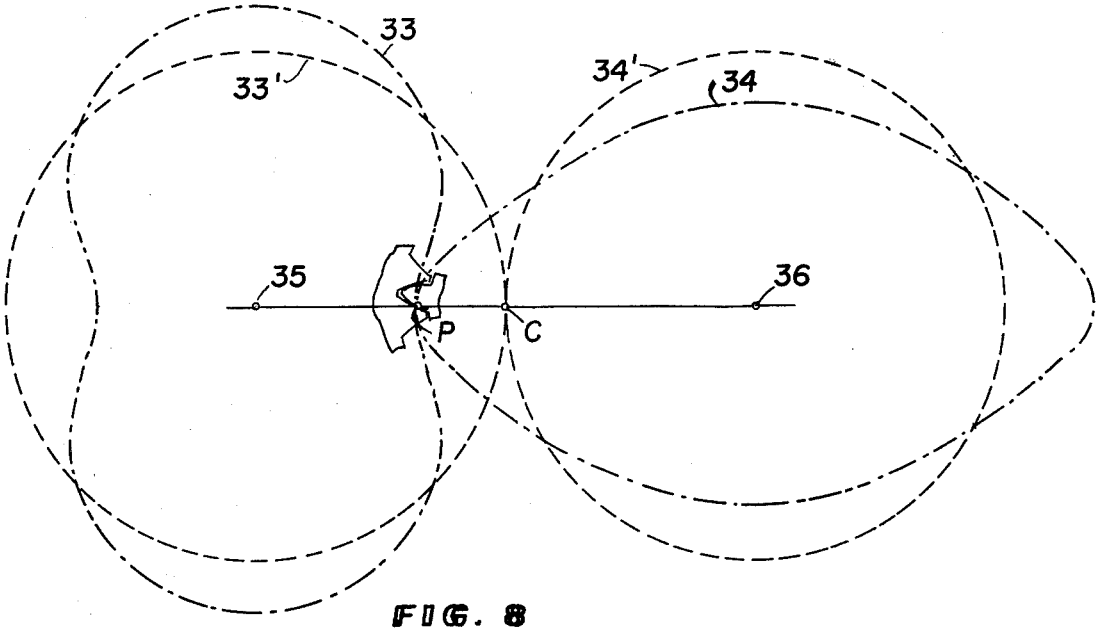
FIG. 8 shows the pitch lines of a pair of varying-motion gears of 1:1 overall tooth ratio. It is used in the embodiment of FIG. 6.

FIG. 8 illustrates the pitch lines of a gear pair with equal tooth numbers. Pitch line 33 is on the gear rigid with the offset shaft that turns uniformly, while pitch line 34 is rigid with a rotor. 35, 36 are the centers of rotation. The two equal circles 33′, 34′ with radius $R = ½(35–36)$ refer to pitch circles of imaginary constant-ratio gears, gears transmitting uniform motion. They contact at fixed point C. The pitch lines 33, 34 always contact each other on the line of centers 35, 36, at any instant at a point P that moves along the line of centers as the gears turn. The portion $(d\theta'/d\theta$ equals the ratio of the distances 35-P to P-36. Let $e$ denote the distance CP. It is negative in FIG. 8.

$$(d\theta'/d\theta = (R + e)/(R - e) = 1 + 2c \cos 2\theta,$$

shown above.

$\theta$ is 90° in FIG. 8.

$$e = R \cdot \frac{c \cos 2\theta}{1 + c \cos 2\theta}$$

At $2\theta = 0$ and 180° $e/R$ becomes $c/(1 + c)$ and $-c/(1 - c$ respectively.

The latter is numerically larger.

A positive $e$ is an increase in the radial distance of point P from center 35 of the offset shaft, and a decrease of the distance from center 36 of the rotor. Pitch line 33 projects less outwardly of circle 33′ than it recedes inwardly thereof. Pitch line 34 of the gear rigid with the rotor projects outwardly of circle 34′ more than it recedes inwardly thereof. It projects outwardly of the uniform-motion pitch circle 34′ more than pitch line 33 projects outwardly of circle 33′. Also the shape of the two pitch lines 33, 34 is quite different, even when the tooth numbers are equal. Pitchline 33 contains concave portions, in the region of closest approach to center 35. Pitch line 34 is convex throughout. All these features are required characteristics for perfect mass-balance, to keep vibrations down and permit operation at high speed, thereby favoring small size.

Generally however I prefer tooth ratios of 1:2.

Figure 7:
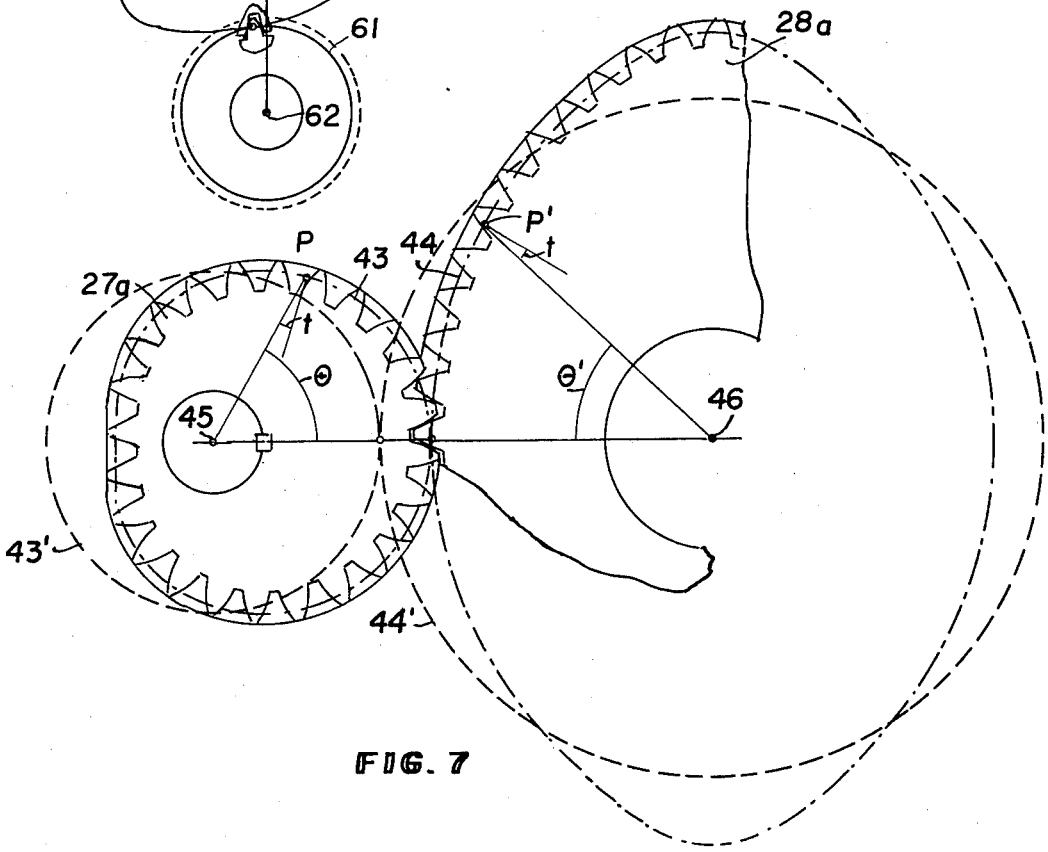
FIG. 7 shows the pitch lines of a pair of varying-motion gears used in the embodiment of FIGS. 1 to 3, showing also tooth profiles. The pitch lines roll on each other without slippage.

FIG. 7 shows pitch line 43 of pinion 27*a* rigid with the uniformly rotating offset shaft, and pitch line 44 of gear 28*a* rigid with a rotor. The circle 43′ and 44′ denote the pitch circles of imaginary uniform-motion gears of the same tooth numbers and center distance. $r$ is the radius of circle 43′, $2r$ the radius of circle 44′. $\theta$ is zero with the gears as shown. $(r + e)$ is the pinion radius to the pitch line. $(2r - e)$ is the corresponding gear radius.

$$\frac{d\theta'}{d\theta} = \frac{r + e}{2r - e} = ½ + c \cos \theta \text{ ; hence}$$

$$\frac{e}{r} = \frac{4c \cos \theta}{3 + 2c \cos \theta}$$

At $\theta = 0$ and 180° this amounts to $4c/(3 + 2c)$ and $-4c/(3 - 2c)$ respectively. The second figure is numerically larger than the first one. Yet they result in perfectly balanced accelerations.

The inclination $t$ of the curved pitch lines to the peripheral direction, and of the pitch-line normal to the radial direction, will now be determined, referring to FIG. 7.

Any point P of pinion 27*a*, with angle $\theta$, and the corresponding point P′ of gear 28*a* secured to a rotor, with angle $\theta'$ has an inclination $t$ defined by $$\tan t = \frac{-de}{(r + e) \cdot d\theta}$$

This can be transformed to $$(r + e) \tan t = \frac{12r \cdot c \cdot \sin \theta}{(3 + 2c \cos \theta)^2}$$

Angle $t$ is the same for pinion and gear, whose pitch lines contact on the line of centers.

In the embodiment of FIG. 7 the circumference of pitch line 43 is exactly half the circumference of pitch line 44, while in the embodiment of FIG. 8 the circumference of pitch line 33 is equal to the circumference of pitch line 34.

The profile inclination to the pitch line is constant all around the circumference, while the tooth-profile curvature at the pitch line varies. The tooth profiles are increasingly curved with increasing curvature of their pitch line. Thus the tooth profile of gear 28*a* is most curved at its maximum radius and least curved at its minimum radius. On pinion 27*a* the tooth profiles are least curved at the minimum radius.

Practical methods for quantity production of these gears will now be outlined.

The many motions required for conventionally producing gears with varying radii render accurate production complicated and difficult. It is proposed here to base quantity production on a master gear that has the same pitch line as the gear to be produced. This eliminates many individual feed motions and greatly simplifies production. The making of the master will be described last.

FIG. 9 shows a gear 28 by its pitch line, with its axis at 50, in engagement with a rack-shaped reciprocatory tool 51. The pitch line 51′ of the tool contacts the gear at 52. Gear 28 is coaxial with a master gear 28*m* (FIG. 10), whose pitch line is identical with the pitch line of gear 28. Master 28*m* meshes with a worm 53 whose axial pitch preferably matches the pitch of the rack shape of tool 51. As tool 51 reciprocates either axially of gear 28, or at an angle thereto, it also moves slowly along its pitch line 51′, while worm 53 turns to provide the same axial displacement. Axis 50 also relatively moves along radial line 55, keeping gear pitch-line 28 in contact with pitch line 51′ of the rack tool, through tooth engagement of both sides of the worm thread with the master gear 28*m* by radial pressure. The master gear may have helical or straight teeth, in which case it will mesh with point contact with worm 53. However master 28*m* can also be built as a wormgear to mesh with line contact.

The radial feed motion may be imparted either to the gear or to the tool.

The feed motion along line 51′ of the rack tool goes on for one pitch. This feed and the worm rotation then stop. The tool is disengaged, returned one pitch, and is then reengaged. The feed starts again while worm 53 starts to turn. This goes on until the gear is completed. The gear axis thereby moves relatively to the tool between end positions 50′, 50″. A roughing operation may precede the finishing cut.

Dotted lines 28' show the gear with its axis in end position 50'.

It should be noted that both the angular timing and the feed 50'–50'' are obtained directly from the master gear. An accurate master will assure an accurate product. And it is equally applicable to the use of straight teeth, FIG. 11, and to teeth inclined to the gear axis, FIG. 12.

Figure 13:
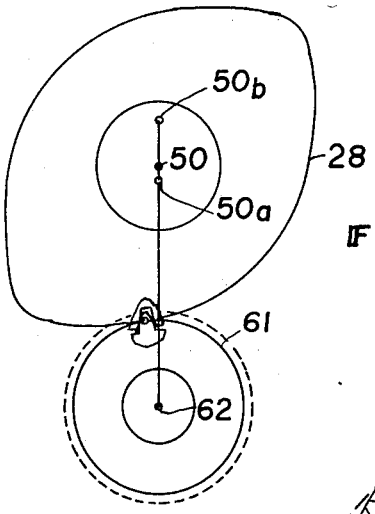
FIG. 13 is a diagram outlining the cutting of a rotor gear with a pinion-shaped reciprocatory tool.

FIG. 13 is a view similar to FIG. 9, but showing a reciprocatory circular gear cutter 61 substituted for the rack-type tool 51 shown in FIG. 9. It also shows gear 28 by its non-circular pitch line that rolls without slippage on the mating pitch line. In the generating motion the circular pitch line of cutter 61 rolls on pitch line 28. This is attained with a master of the same pitch line 28 meshing with a gear having a pitch circle like cutter 61. This gear is coaxial with the cutter in the finishing cut. Tooth engagement is maintained with both sides of the teeth by radial pressure. Axis 50 of gear 28 moves relatively to the cutter axis 62 between end positions **50*a*, 50*b*. The cutter reciprocates on its axis 62** either straight or helically. Cutting is here a continuous process without reversal.

FIGS. 14 and 15 show face mills 65, 66 for generating a gear 28 (shown by its pitch line) and its mating pinion 27. Cutter 65 describes a single tooth of a rack at a time.

To attain a desired length of tooth bearing, the cutter 66 of the pinion may cut one side of the pinion teeth at a time, the longitudinally convex side. Another larger cutter may then be used to cut the longitudinally concave side.

In the shown position of gear 28 pitch-line contact is achieved at point 67 offset from the central plane. This is approximately the center of tooth contact in this portion. It should be the center of the generating roll, to minimize its length. To keep it the center of roll, a lateral feed is added. This added feed is at right angles to the relative radial feed between axis positions **50*c*, 50*d***.

The workpiece is here also kept rigid with a master gear that meshes with a rack, a rack that moves laterally with the cutter. To the two linear feeds in a plane perpendicular to the workpiece axis is added a lateral generating feed of the cutter and rack and a corresponding turning motion, always keeping the pitch plane in contact with pitch line 28. This lateral generating feed repeats for each tooth space or tooth side, together with what goes with it. It generally extends through more than one pitch. In each cycle the workpiece is indexed through one tooth. The timing is taken care of by the mesh of the worm embodying said rack.

FIG. 18 outlines the production of a gear 28 without a master gear. To attain the same relative displacements as in FIG. 14, the lateral and radial displacements are enforced by cam means. A generating roll is effected through a range exceeding one pitch, as before, comprising a uniform lateral relative displacement together with the necessary varying lateral and radial displacements and turning motion of the gear, to keep the pitch lines in contact. The turning motion is attainable by axially displacing the turning worm 70. This worm meshes with wormgear 71 to which the gear 28 is secured. The lateral and radial displacements are here attained with a pair of coaxial cams 72, 73 centered at 74 (FIG. 19). These turn at uniform speeds and engage plane-sided abutments 75, 76 with which they are kept in contact by pressure. In place of abutment 75 a roller 77 might used.

The face-mill cutter or grinding wheel shown in full lines at 80 in FIG. 18 goes through relative displacements with respect to the gear axis **50*c* as shown in dotted lines 80', 80''**.

Instead of using the just described procedure with the many motions, the simpler procedure described in application Ser. No. 551,102, filed Feb. 20, 1975, may be used for producing the master gears.

FIG. 20 shows the production of gear 28 by means of a hob or threaded grinding member 82. Gear 28 is secured to a master gear. The hob is very slowly fed axially of the workpiece as the latter turns, to produce straight or helical teeth. The relative path of the gear axis 46 is indicated in dotted lines **46, 46*x*, 46*y***.

Numerous variations may be made in the production of the gears based on a master gear. For definition of the scope of the invention it is relied on the appended claims.

I claim:

1. A rotary unit for positive displacement of fluid having two coaxial rotors whose arms project outwardly from their axis inside of a housing, a shaft offset from the rotor axis for transmission of motion between said rotors and the outside, a pair of varying-motion gears directly connecting said shaft with one of the rotors, another pair of varying-motion gears of opposite phase directly connecting said shaft with the other rotor, to achieve spaces of varying volume between said arms, wherein the gear pitch-lines that roll on each other without slippage differ on the two gears of each pair, and intersect the pitch circles of a pair of imaginary uniform-motion gears coaxial therewith and of the same tooth ratio, the pitch line of said gear on each rotor contains two diametrically opposite maximum radii and perpendicular thereto two minimum radii, is convex throughout, and projects outwardly of said pitch circle more than it recedes inwardly thereof, having a smaller radius of curvature at the two maximum radii than an ellipse of the same maximum and minimum radii, the tooth profiles are equally spaced along said pitch lines and have a constant inclination thereto, and the tooth profiles have curvature radii varying with the curvature radii of the pitch curves.

2. A unit according to claim 1, wherein both gears of a pair of varying-motion gears have equal tooth numbers, the curved pitch line of the gear secured to a rotor extends to a larger distance from its axis than the pitch-line of its mate, and meshes there with concave pitch-line portions of its mate while itself being convex throughout.

3. A unit according to claim 1, wherein the varying-motion gears rigid with the respective rotors have double the number of teeth of the gears rigid with said offset shaft mating therewith, so that the varying motion repeats twice per turn of each rotor.

4. A unit according to claim 3, wherein the varying-motion gear pair is designed to provide a turning angle of the rotor of one half of the turning angle ($\theta$) of the offset shaft plus an added turning angle proportional to the sine function ($\sin \theta$) of the turning angle of said offset shaft.

5. A unit according to claim 4, wherein the varying-motion gear pairs are designed with teeth inclined to the direction of their axes.

* * * * *